US006789725B2

(12) United States Patent
MacEwen et al.

(10) Patent No.: US 6,789,725 B2
(45) Date of Patent: Sep. 14, 2004

(54) PRINTABLE ENVELOPE WITH L-SHAPED ADDITION

(75) Inventors: Tamara L. MacEwen, Rancho Cucamonga, CA (US); Ronald Ugolick, San Dimas, CA (US); Manish M. Bhakta, Huntington Beach, CA (US); Dale E. Loree, Laguna Niguel, CA (US); Russell D. Pollman, El Paso, TX (US); Norman Yamamoto, Yorba Linda, CA (US)

(73) Assignee: Avery Dennison Corporation, Pasadena, CA (US)

( * ) Notice: Subject to any disclaimer, the term of this patent is extended or adjusted under 35 U.S.C. 154(b) by 122 days.

(21) Appl. No.: 10/223,950

(22) Filed: Aug. 20, 2002

(65) Prior Publication Data

US 2003/0160090 A1 Aug. 28, 2003

Related U.S. Application Data

(60) Provisional application No. 60/360,496, filed on Feb. 28, 2002.

(51) Int. Cl.[7] ..... B65D 27/10

(52) U.S. Cl. ..... 229/69; 229/68.1

(58) Field of Search ..... 229/68.1, 69, 300, 229/92.1, 92.3, 305, 304, 92.8, 303; 281/2, 5

(56) References Cited

U.S. PATENT DOCUMENTS

| | | | | |
|---|---|---|---|---|
| 174,940 A | * | 3/1876 | Brown | 229/68.1 |
| 929,516 A | | 7/1909 | Toliver | |
| 1,453,616 A | | 5/1923 | Benenato | |
| 1,467,148 A | * | 9/1923 | Farkas | 229/92.1 |
| 1,736,588 A | | 11/1929 | Galter | |
| 1,893,086 A | | 1/1933 | Keller | |
| 2,013,844 A | | 9/1935 | Sherman | |
| 2,028,341 A | | 1/1936 | Masterson et al. | |
| 2,671,602 A | | 3/1954 | Vogt | |
| 2,715,493 A | | 8/1955 | Vogt | |
| 2,824,686 A | | 2/1958 | Hamilton | |
| 3,126,211 A | * | 3/1964 | Hieken et al. | 283/101 |
| 3,170,620 A | | 2/1965 | Nirenstein | |
| 3,319,872 A | | 5/1967 | Beckman et al. | |
| 3,372,861 A | | 3/1968 | Johnson et al. | |

(List continued on next page.)

FOREIGN PATENT DOCUMENTS

JP 3227696 A 8/1991

*Primary Examiner*—Jes F. Pascua
(74) *Attorney, Agent, or Firm*—Fulwider Patton Lee & Utecht

(57) ABSTRACT

A paper assembly is formed having an envelope and a carrier portion, such that the overall assembly is a generally flat paper assembly having a length and width of a standard paper size such as 8½ in.×11 in. or A-4 size. The assembly, having a footprint equal to a standard paper size, may be fed into a standard size paper tray of a printer such as a laser printer or an ink jet printer, with the printer printing on the front face of the envelop. After printing the envelope may be stuffed with material to be mailed, and the envelope separated from the carrier portion and sealed for mailing. In a first embodiment the carrier is an L-shaped piece of paper that is formed separately from the envelope and releasably adhered to the backside thereof, the L-cut having an acute angle and a rounded corner. In another embodiment the L-shaped carrier is releasably adhered to the front side of the envelope. In another embodiment the entire assembly including the carrier portion and the envelope is formed from a single oversized die cut sheet of paper, folded and glued to create an envelope releasably connected by cuts and ties to the remainder of the assembly to form an assembly having a footprint equal to a standard size sheet of paper, and then loaded into a standard size printer tray for printing on the envelope. After being printed upon the envelope is separated from the carrier portion and sealed for mailing.

19 Claims, 4 Drawing Sheets

U.S. PATENT DOCUMENTS 3,559,875 A 2/1971 Wilson
3,560,025 A 2/1971 Ostrander
3,666,926 A 5/1972 Conte, Jr. et al.
3,758,025 A 9/1973 Schafer
3,980,006 A 9/1976 Welch
4,157,759 A 6/1979 Dicker
4,335,845 A 6/1982 Dierks et al.
4,497,509 A 2/1985 Gore
4,669,652 A 6/1987 Seguin
4,690,392 A 9/1987 Coons, Jr.
4,705,297 A 11/1987 Wakeman
4,708,285 A 11/1987 Segall
4,747,535 A 5/1988 Haase et al.
4,754,915 A 7/1988 Steidinger
4,784,317 A 11/1988 Chen et al.
4,807,805 A 2/1989 Rutkowski
4,878,613 A 11/1989 Badger et al.
4,898,323 A 2/1990 Chen et al.
4,915,288 A 4/1990 Kao et al.
4,948,028 A 8/1990 Vollowitz
5,005,758 A 4/1991 Richards et al.
5,040,720 A 8/1991 Pennock
5,050,792 A 9/1991 Segall
5,069,384 A 12/1991 Bell
5,087,238 A 2/1992 Olson
5,104,036 A 4/1992 Rutkowski et al.
5,413,383 A 5/1995 Laurash et al.
5,415,341 A 5/1995 Diamond
5,421,620 A 6/1995 Sauerwine
4,784,317 A 10/1995 Chen et al.
5,474,229 A 12/1995 Shimazaki
5,558,454 A 9/1996 Owen
5,634,587 A * 6/1997 Popat et al. ..... 229/69
5,743,566 A 4/1998 Hunter et al.
5,746,450 A 5/1998 Petkovsek
5,755,433 A 5/1998 Klein
5,779,612 A 7/1998 Whitney
5,887,780 A 3/1999 Popat et al.
6,004,062 A 12/1999 Hunter et al.
6,010,159 A 1/2000 Warther
6,050,603 A 4/2000 Petkovsek
6,071,030 A 6/2000 Hunter et al.
6,149,205 A 11/2000 Attia et al.
6,179,334 B1 1/2001 Petkovsek
6,283,362 B1 9/2001 Michlin
6,450,399 B1 9/2002 Attia et al.
6,559,970 B1 * 5/2003 Yamamoto et al. ..... 358/1.18
2001/0002679 A1 6/2001 Fabel

* cited by examiner

PRINTABLE ENVELOPE WITH L-SHAPED ADDITION

RELATED APPLICATIONS

This application claims priority from U.S. Provisional Application No. 60/360,496 filed Feb. 28, 2002, and from U.S. Non-Provisional application Ser. No. 09/694,197 filed Oct. 23, 2000.

FIELD OF THE INVENTION

The present invention relates to the construction of an envelope assembly which can be fed into and printed on by laser and/or inkjet printers without skewing. More particularly the present invention relates to an envelope assembly which has the same dimensions as a standard sheet of paper, such as 8-½ in.×11 in. or A-4 sheet, and which can be fed into a laser and/or inkjet printer through the lower cassette tray.

BACKGROUND OF THE INVENTION

Many printable envelopes which lend themselves to either laser printers or inkjet printers are in use today. Unfortunately, today's printable envelopes are subject to "skewing" which results when an envelope travels in a misaligned manner through a printer. This results in the address being printed by the printer in a crooked orientation on the envelope. This misalignment is caused by the envelope, which is aligned with one side of the printer's paper tray, migrating away from the side or edge of the tray during the printing process.

To prevent this skewing the consumer will typically hand feed the envelopes one-at-a-time into the printer. Unfortunately, this is a very time consuming process. Also, the inability to load the multipurpose paper tray with more than a few envelopes at a time prevents large-scale mailings and mail merges wherein a computer program accesses multiple names from a pre-existing database and sends them directly to the printer. Thus, today's envelopes are essentially unusable for large volume mailing applications using the personal computer (PC) unless special envelope feeders are employed.

Additionally, an industry has developed to supply postage over the Internet (see, e.g., www.stamps.com). PC postage allows consumers to print postage-metered labels at their home. Every time a consumer prints a postage label, he is charged for the postage by the PC postage firm; that is, the act of printing triggers the postage charge. Unfortunately, with today's envelopes the postage label must be applied by the printer in a step separate from the address printing step. This is because if the consumer attempts to print directly onto normal envelopes, the above-discussed envelope skewing can cause the print to run off the edge of the envelope. This can result in the stamped envelope not being honored by the Post Office. In other words, the consumer will still be charged by the PC postage firm for the PC postage printed envelope even though the envelope is unacceptable to the Post Office due to the skewed printing of the postage label.

SUMMARY OF THE INVENTION

An envelope is provided with a generally L-shaped addition. The envelope and the addition are releasably held together so as to form an overall assembly having a length and width generally equal to a standard paper size, such as 8-½ in.×11 in. which is standard in the United States, or A-4 which is standard in most other countries including the European countries. Because the assembly is of a standard width and length the assembly can be fed into a printer without the need to use a separate envelope guide, and without resulting in skewing. Because the assembly is of a standard length the assembly can be fed through a printer without the printer sensing that the assembly did not have a back edge when the printer expected to detect a back edge and therefore aborting the print job and producing a "printer error" message. The assembly can be loaded into and fed through a lower printer cassette tray of laser printers, ink jet printers, or other printers which interface to personal computers. In this way the present invention transforms an envelope into an 8-½ in.×11 in. or other standard size assembly which can be fed through the lower cassette tray of a laser printer in large quantities and at high speeds. The assembly can also be loaded into other imprinting devices such as digital copiers and photocopiers. In this way a large number of envelopes may be accurately, reliably, and quickly printed with a destination address, a return address, postage, and/or other informational or decorative matter, without the need for human intervention such as feeding small numbers of envelopes one at a time into a printer's "manual" or multipurpose feeder tray. Because the lower tray of a laser printers is also designed to hold paper sheets more securely than the multipurpose feeder tray, the present invention also allows envelopes to be printed with less chance of skewing.

In a first embodiment, the envelope and an L-shaped carrier are constructed separately. The L-shaped carrier is then releasably adhered to the back of the envelope. The two pieces may be releasably adhered together using a variety of known techniques such as by removable adhesive, a pressure sensitive adhesive (PSA) on one piece with the other piece coated with a release material such as silicone, or a weak permanent adhesive such as a dry laminate. The carrier, which is placed over the back side of the envelope, partially overlaps the envelope along the envelope's side edge to allow nearly full access to the envelope pocket for stuffing. The carrier overlaps the top of the envelope only on its closure flap, again to allow access to the envelope pocket for stuffing. The assembly may further include a release strip separating the carrier from the closure flap in order to give the consumer the option of either separating the carrier and release strip from the envelope in a single step, or separating the carrier from the envelope while leaving the release strip protecting the adhesive over the closure flap. If the consumer leaves the release strip on the envelope, then he can then peel off the release strip when he is ready to seal the envelope. In a second embodiment utilizing only two pieces, a flap closure adhesive is used which does not require a separate release strip. In a third embodiment, the carrier is adhered to the front of the envelope, overlapping the envelope slightly, leaving the front of the envelope sufficiently uncovered to allow desired matter to be printed on the face of the envelope such as a destination address, a return address, postage, and any other information or decorative material.

In a fourth embodiment, the envelope and carrier are integrally formed from a single oversized die cut sheet of paper. The paper is cut and folded to form an envelope and an L-shaped appendage or extended portion, defining overall an assembly of a standard paper size. In the folded state the assembly defines an envelope separably attached to the L-shaped appendage by cuts and ties or other weakened separation line. The folded assembly may then be fed into a printer or copier, printed upon, and then separated from the L-shaped appendage. As in the other embodiments, the stuffing step can be performed either before or after the envelope has been separated from the L-shaped piece. The portion of the L-shaped piece that will abut the closure flap after folding may be treated with a release material such as silicone to prevent the closure flap from sticking to that piece.

It is further noted that the envelope sealing flaps are preferably coated with permanent PSA. When the assembly does not include an extra release strip, the L-shaped carrier may be coated with release material where it overlies the PSA. It is also noted that the L-shaped carrier also facilitates loading of the envelope by holding the envelope flap open and providing extended guidance as papers are inserted into the envelope. Accordingly the L-shaped carrier performs several useful functions including (1) ensuring non-skewing printing of the envelope, (2) covering the PSA on the sealing flap until the envelope is to be sealed, and (3) facilitating loading of materials to be enclosed in the envelope.

Exemplary embodiments of the invention will be further described below with reference to the drawings, in which like numbers refer to like parts.

DETAILED DESCRIPTION OF EXEMPLARY EMBODIMENTS

The disclosures of U.S. Provisional Application No. 60/360,496, filed Feb. 28, 2002, and U.S. Non-Provisional application Ser. No. 09/694,197, filed Oct. 23, 2000, are hereby incorporated by reference as if set forth herein in their entireties. In the discussion which follows, the invention will be illustrated with reference to a No. 10 envelope and an 8-½ in. by 11 in. standard size sheet. However, it will be understood that the invention is applicable to virtually any envelope size, and to any standard size sheet of paper including A-4 paper, which measures approximately 8-¼ in.×11⅝ in. and which is standard in most countries other than the U.S, legal size paper, or other size paper. It will also be understood that the invention could be applied to make assemblies of non-standard sizes if desirable, as for example for use with special sized feeder trays for highly specialized promotional mailings. Similarly, the discussion which follows will refer to a laser printer connected to a personal computer (PC), although it will be understood that the invention may be used in conjunction with, and provides advantages when so used with, a variety of other imprinting devices such as ink jet printers, digital copiers, and photocopiers, whether connected to a PC, a mainframe, a network, or any other data source.

Figure 1:
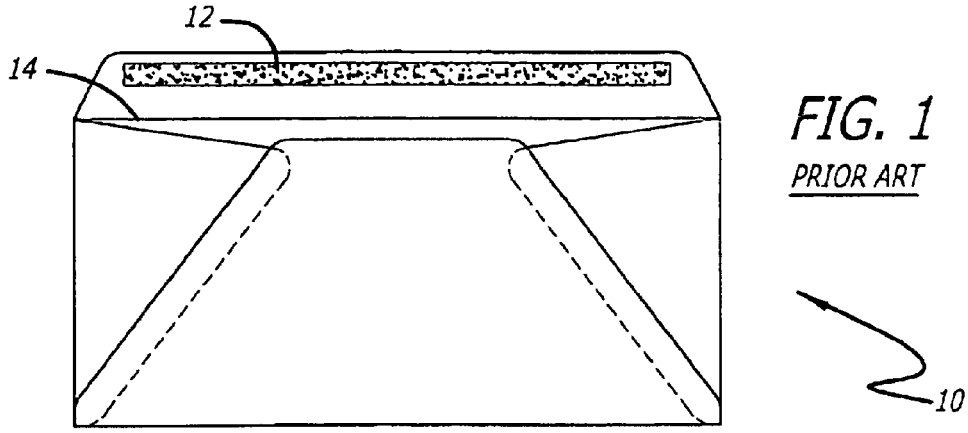
FIG. 1 PRIOR ART
FIG. 1 is a plan view of the back side of a prior art diagonal cut envelope.

FIG. 1 shows the back side of a prior art envelope 10, such as a No. 10 envelope. Envelope 10 has a closure flap 12 which carries an adhesive such as a moisture activated gum or PSA. Closure flap 12 is connected to the envelope body by closure flap fold 14. The envelope is shown having diagonally cut side flaps and back panel.

Figure 2:
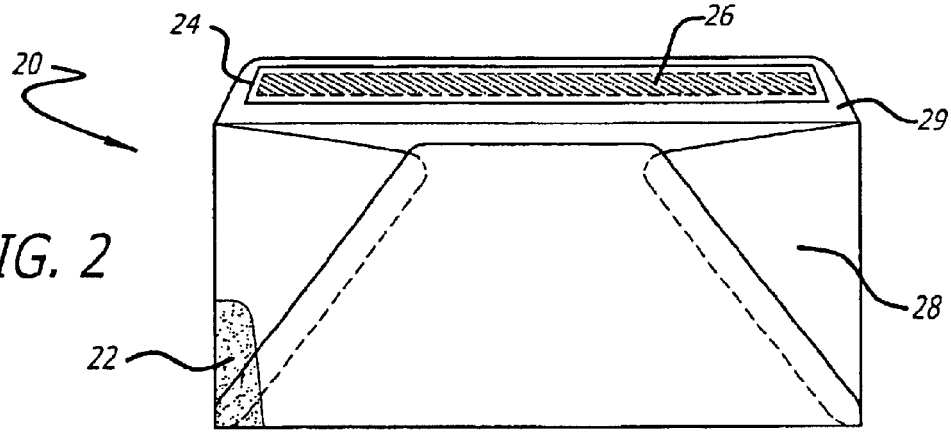
FIG. 2 is a plan view of the back side of an envelope for use in a first embodiment of the invention.
Figure 3:
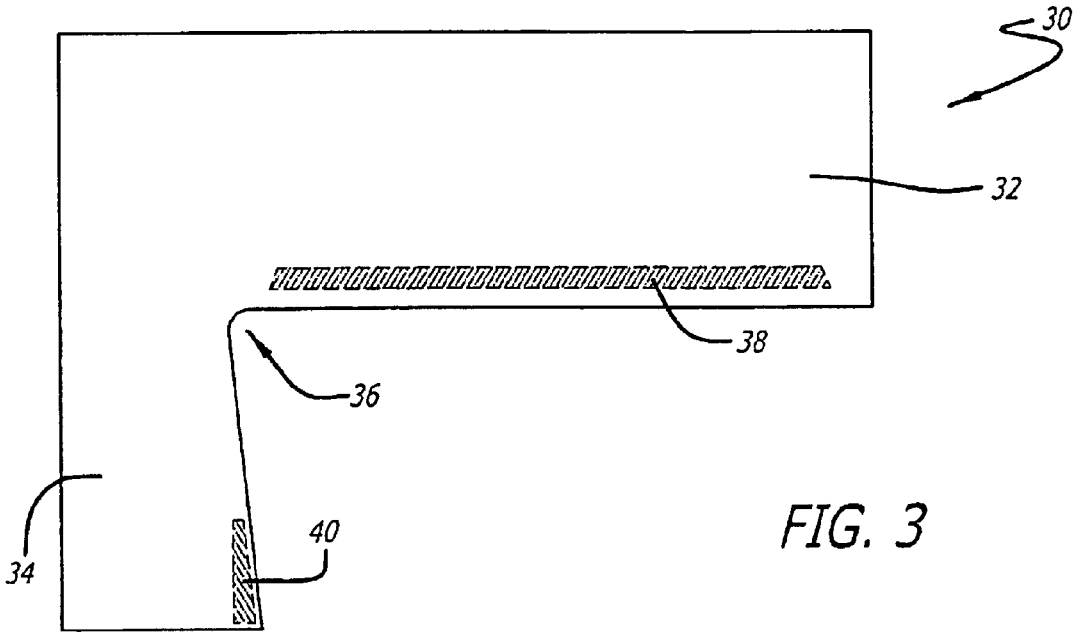
FIG. 3 is a plan view of an L-shaped carrier for use in the first embodiment of the present invention.

FIG. 2 and FIG. 3 show an envelope and L-shaped add-on, respectively, according to a first embodiment of the present invention. Envelope 20 is a diagonal cut envelope which includes an envelope body 28 and a closure flap 29. The lower left corner of envelope body 28 includes an optional area 22 which is coated with a thin layer of release material such as silicone as is well known in the relevant industry. Closure flap 29 includes a pressure sensitive adhesive (PSA) 26. PSA 26 is covered and protected by a release strip or release paper 24. L-shaped add-on or carrier 30 includes a main portion or vertical portion 32 and a leg portion 34. Portion 32 will be called a vertical portion for convenience of discussion regardless of the fact that it is not actually vertically oriented in the figures. A strip of the vertical portion 32 carries a PSA 38, and a strip of the leg portion 34 carries a PSA 40. Alternatively, other adhesives may be used as will be discussed more fully below. The angle that is defined by the intersection of vertical portion 32 and leg portion 34 is preferably slightly acute, meaning that it is less than 90 degrees, for reasons that will be explained, although the angle may alternatively be a right angle. Thus, the distal or far end of leg 34 is at least as wide as the near or proximal end of leg 34. The internal corner 36 formed by the intersection of the two portions 32 and 34 of the carrier is rounded to prevent carrier 30 from tearing at that corner when it is peeled back from the envelope and removed therefrom.

Figure 4:
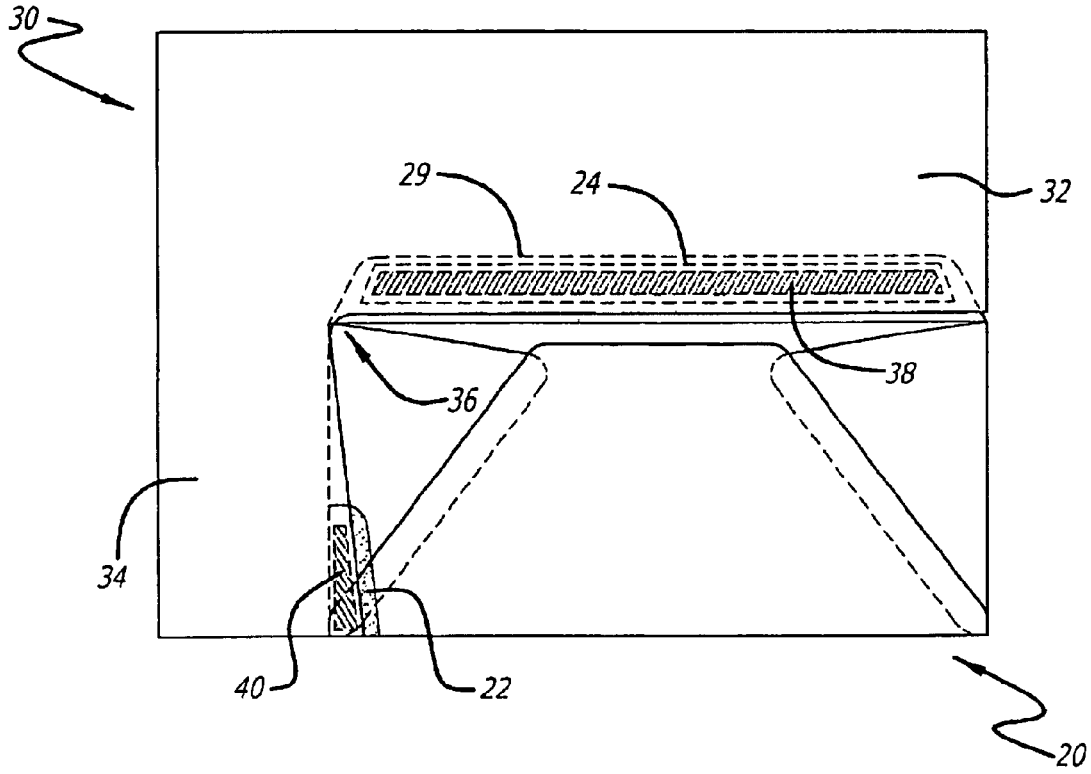
FIG. 4 is a plan view showing the envelope of FIG. 1 and the L-shaped carrier of FIG. 2 releasably adhered together to form the first embodiment of the present invention.

FIG. 4 shows the envelope and carrier releasably adhered together to form an overall generally flat paper assembly that has the footprint of a standard 8-½ in.×11 in. sheet of paper. The distal end of leg 34 overlaps the lower left corner of the back side of envelope 20 with sufficient area of overlap to allow the two areas to be reliably adhered together for printing. At the same time, leg 34 preferably tapers so that at the upper left corner of envelope 20 the carrier overlaps the envelope opening only slightly. Preferably the overlap at the distal end is greater than 0.25 inches (0.64 cm), and the overlap at the envelope opening is less than 0.25 inches (0.64 cm). A standard No. 10 envelope is approximately 9-½ in. wide, leaving approximately one inch of spare stuffing width beyond the standard 8-½ in. wide piece of paper. Thus, the overlap at the opening of a No. 10 envelope could be as great as 0.5 in. (1.27 cm), 0.75 in. (1.91 cm) or nearly 1 in. (nearly 2.54 cm) without rendering the envelope completely unstuffable with the carrier attached. The area of adhesion need not extend all the way up the side edge of the envelope. Because the envelope opening is only slightly covered by the carrier, the assembly as shown in FIG. 4 can be stuffed with material to be mailed or otherwise carried within the envelope while the carrier is still held to the envelope. It is not necessary that the carrier overlap the envelope opening only slightly if it is not necessary in a particular application to stuff the envelope while it is still attached to the carrier.

The carrier and the envelope may be releasably adhered together using any of a variety of materials and techniques that are known within the relevant art. In a first technique, a permanent but weak adhesive such as a dry laminate is used to adhere the two pieces together. When the pieces are separated, both sides remain dry and non-sticky. In a second technique, a removable adhesive such as a hot melt removable adhesive may be used. The removable adhesive may be applied to the envelope for ease of manufacturing in either a strip or in one or more spots. The two pieces are then pressed together to adhere them. When the two pieces are separated the adhesive transfers to the carrier, leaving the envelope non-sticky. When the two pieces are separated the adhesive remains on the carrier, leaving the envelope non-sticky. In a fourth technique, a tacky adhesive such as a PSA is applied to the carrier, and an area of the envelope that will contact the tacky adhesive is treated or otherwise coated with a release material such as a thin layer of silicone so that after the two pieces are pressed together the carrier may later be peeled away from the envelope. FIG. 4 depicts this technique, in which a tacky adhesive area 40 on carrier 34 adheres releasably to a silicone coated area 22 on the envelope.

Figure 5:
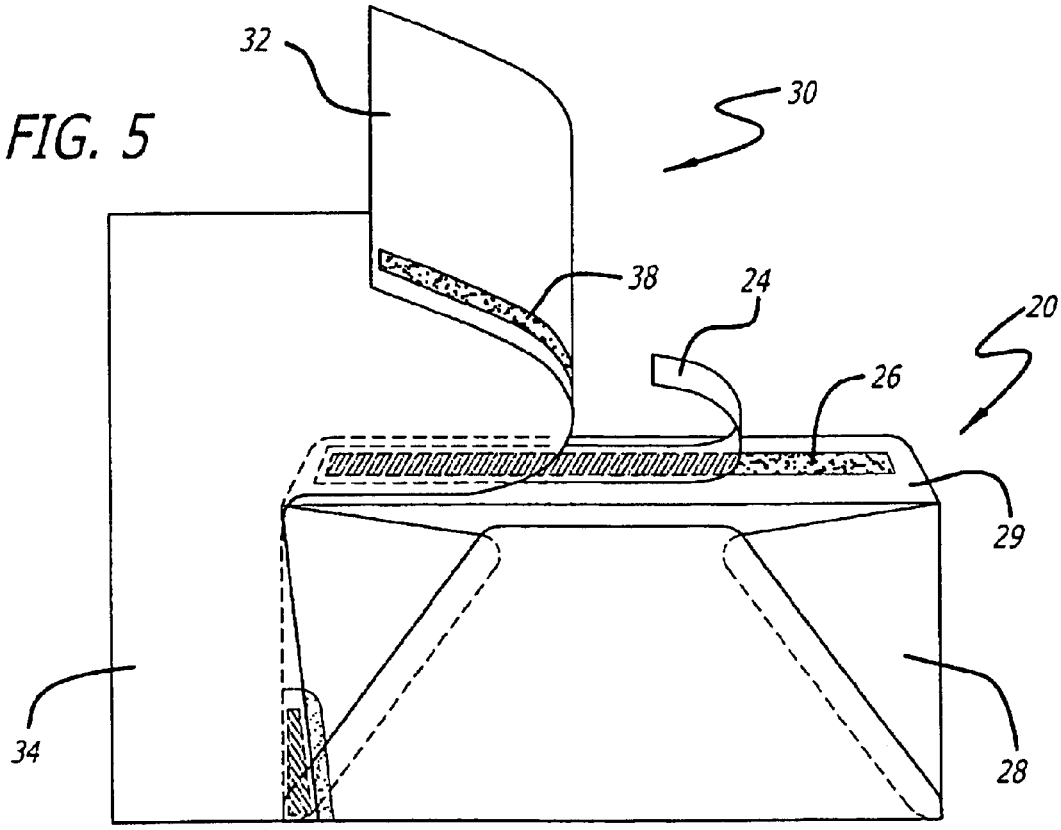
FIG. 5 shows the L-shaped carrier and an optional release strip being peeled away from the back of the envelope according to the first embodiment of the present invention.
Figure 6:
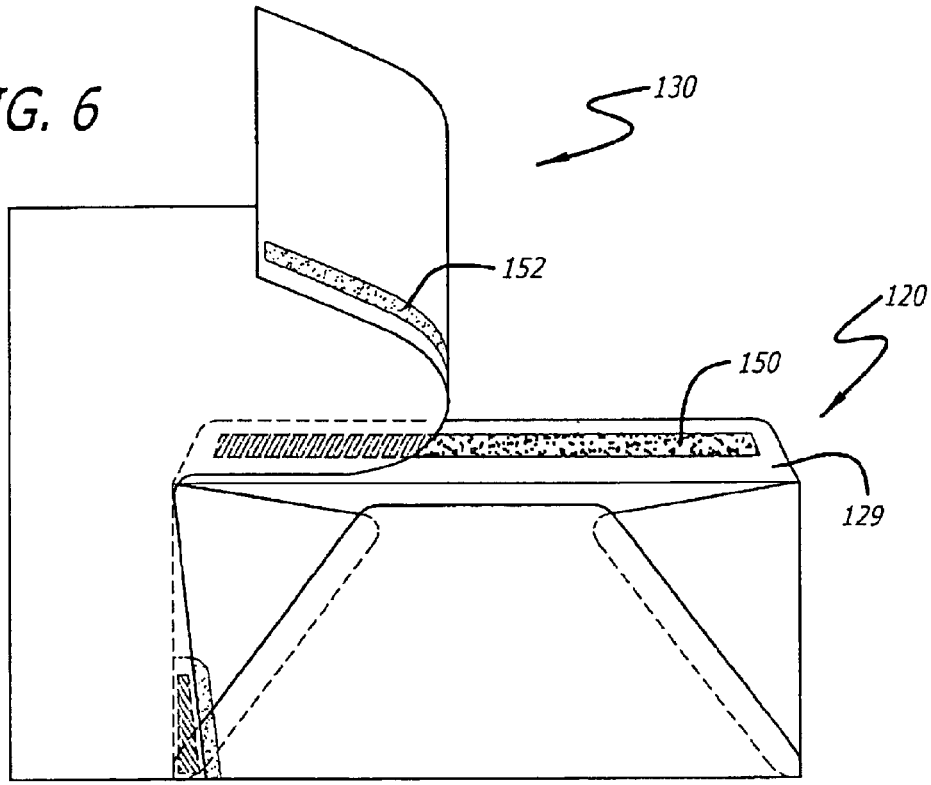
FIG. 6 shows a second embodiment similar to the first embodiment of FIG. 5 but without the optional release strip.

The carrier may likewise be releasably attached to the envelope in the area of closure flap 29 by a variety of known materials and techniques. In a first technique, the closure flap includes a moisture activated gummed strip for sealing the envelope, and a dry laminate weakly adheres a non-gummed portion of the closure flap to the carrier. In a second technique depicted in FIG. 5, PSA strips 26 and 38 are applied to closure flap 29 and carrier 30, respectively. The two PSA strips 26 and 38 are separated by a release strip 24 disposed therebetween. Alternatively, release strip 24 may be adhered to carrier 30 via a permanent or removable adhesive. In a third technique depicted in the second embodiment of FIG. 6, a tacky adhesive such as PSA 150 releasably adheres to a corresponding release material 152 on carrier 130. Other techniques for releasably adhering pieces of paper together may be used, with attendant known advantages and disadvantages. In the embodiment shown in FIG. 5 carrier 30 is being peeled away from envelope 20, and release strip 24 is being peeled away from closure flap 29. Once release strip 24 has been peeled away from PSA 26 on closure flap 29, the envelope may be sealed by folding closure flap 29 down and pressing it against envelope body 28. An advantage of this particular technique for constructing the assembly is that the user has the choice of either peeling away carrier 30 and release strip 24 all in one motion to leave the envelope ready for sealing, or peeling away only carrier 30 leaving release strip 24 in place such that the envelope may be stuffed, stacked, or otherwise handled without closure flap 29 becoming unintentionally stuck to anything. The user has the flexibility to peel away release strip 24 only when he is ready to permanently seal the envelope.

As can be seen in the figures, envelopes 20 and 120 are diagonal cut envelopes meaning that their side flaps and back flaps which fold up to form the back sides of the envelopes are all diagonally cut. An advantage to using such diagonal cut envelopes in the present invention is that doing so minimizes the areas that are four paper layers thick. As an additional feature, carrier 30 is made from a paper that is a different color than envelope 20 to help visually convey to the user how the product works. The overall assembly is generally flat, meaning that it is flat enough to be processed through a laser printer, photocopier, or other printing device.

Figure 7:
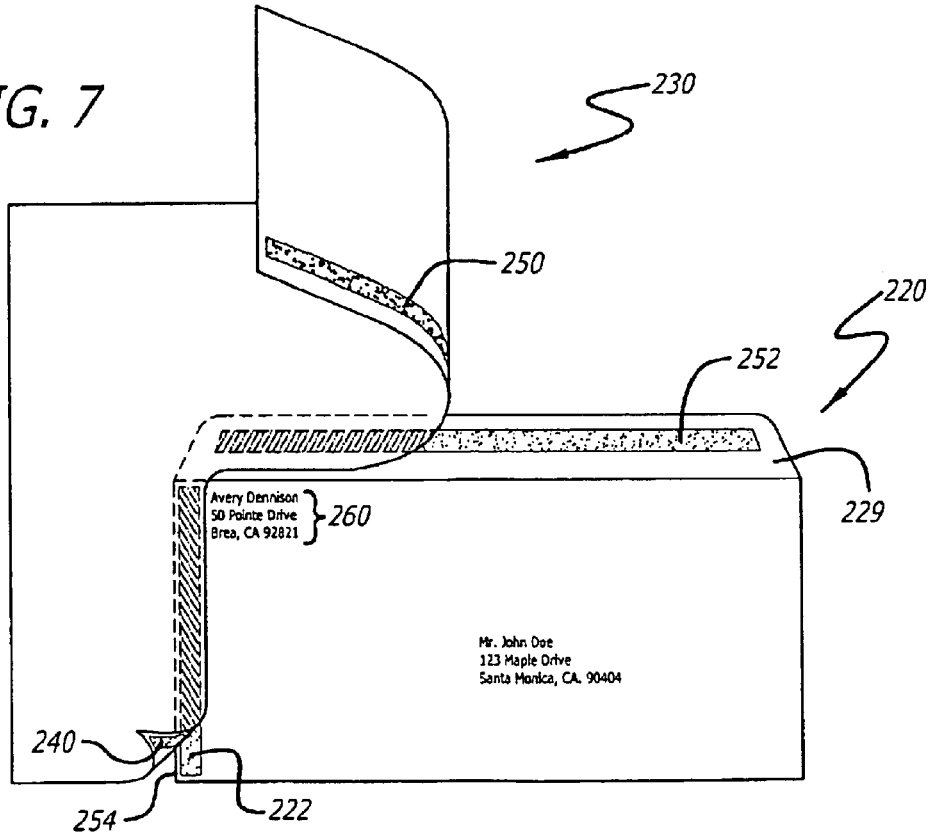
FIG. 7 shows a L-shaped carrier being peeled away from the front of an envelope according to a third embodiment of the present invention.

FIG. 7 depicts a third embodiment in which carrier 230 is releasably adhered to the front side of an envelope 220 rather than the back side. The carrier includes PSA's 240 and 250, and the envelope includes silicone coated areas 252 and 222 on closure flap 229 and left envelope edge 254, respectively. The silicone coated areas allow the envelope to be separated from the carrier leaving the envelope non-sticky. As discussed more fully above, the releasable adhesive need not be a PSA in combination with silicone, but may be any of a variety of materials and methods for creating releasable adhesion. In this embodiment the carrier overlaps enough of edge 254 to create a reliable connection for printing, but leaves enough of envelope 220 exposed so that a return address 260, a destination address, and postage can be printed thereon.

Figure 8:
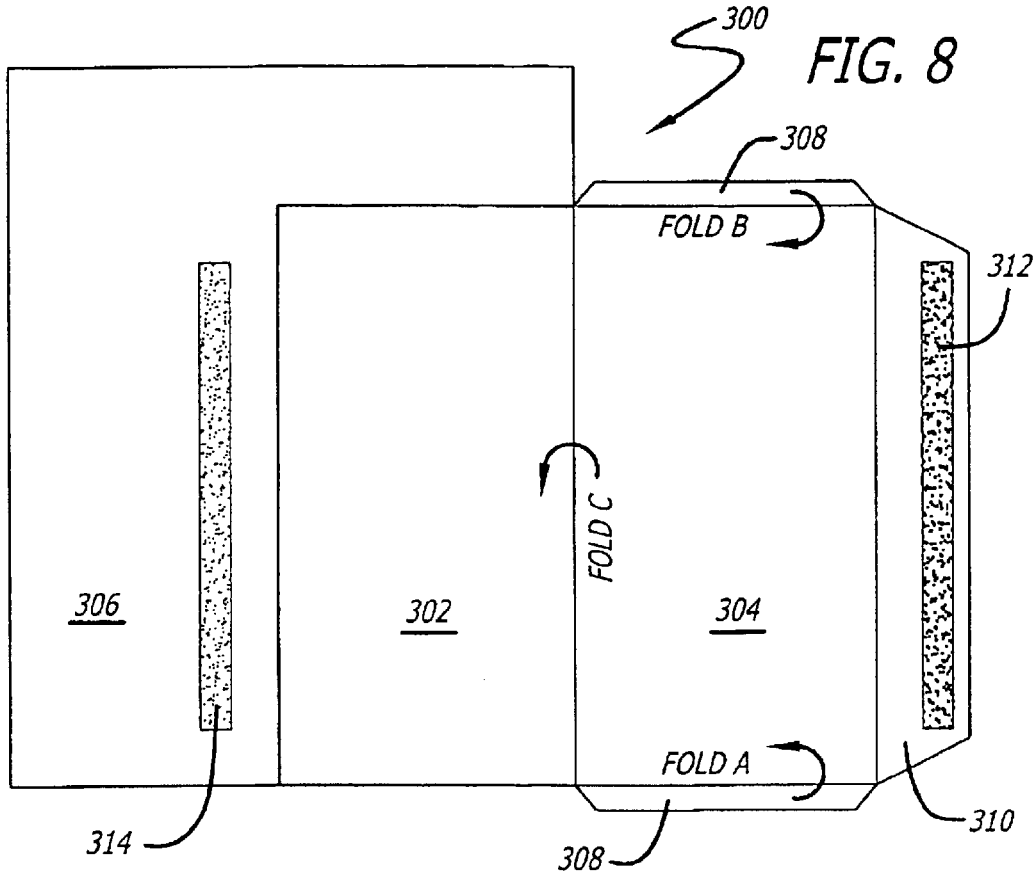
FIG. 8 is a plan view of an assembly comprising a single die cut sheet of paper which will be folded and glued to form an envelope releasably attached to an L-shaped extended portion, according to a fourth embodiment of the present invention.

FIGS. 8–9 illustrate a fourth embodiment of the invention. In this embodiment rather than the envelope and the carrier being formed separately and thereafter releasably adhered together, a unitary envelope assembly 300 having an envelope and a generally L-shaped carrier area or extended portion 306 releasably attached thereto are integrally formed from a single die cut sheet of paper. From the single sheet of paper sufficient material is cut away to leave a first portion measuring 8-½ in.×11 in., and a second portion consisting of an envelope front 304, side flaps 308, and closure flap 310. Score lines are formed in the assembly to define side flap fold lines along folds A and B in the figure, a closure flap fold line along the bottom of closure flap 310, and a body fold line along fold C. Cuts and ties 320 are formed to define a separable portion that will become the envelope back face 302. Alternatively, other well known methods of creating a weakened separation line such as by perforation can be used to define separable portion 302. The adhesive on the closure flap 310 may be formed in any of several ways. In a first variation, strip 312 is a moisture activated gum that is applied to closure flap 310. In a second variation, strip 312 is a release strip that has a PSA on both sides, and a release material such as silicone between release strip 312 and the paper which forms closure flap 310. When the envelope is folded together the release strip will stick to area 314. If the adhesive on the back of release strip 312 is a permanent adhesive, then release strip 312 will permanently stick to area 314 thereby peeling away the closure strip 312 from closure flap 310 when the envelope is separated from the rest of the assembly. In a third variation, strip 312 is a PSA and area 314 is either an area that has been treated with a release material such as silicone, or area 314 is a strip of silicone-treated tape that has been applied to area 306. In a fourth variation, the release strip 312 has release material on both sides to allow removal of the L-shaped member while allowing the release strip 312 to remain covering the adhesive on closure flap 310. All of the foregoing techniques for preventing closure flap 310 from sticking to area 306 while allowing closure flap 310 to effectively seal the final envelope are within the scope of the present invention. Additionally, a permanent adhesive (not shown) is applied to side flaps 308. The permanent adhesive may be a glue or other suitable adhesive. Side flaps 308 are then folded in and envelope front 304 is folded up onto envelope back 302 to form a complete envelope having a pocket attached to extended portion 306. Other configurations of the envelope are possible, including without limitation triangular side flaps.

Figure 9A:
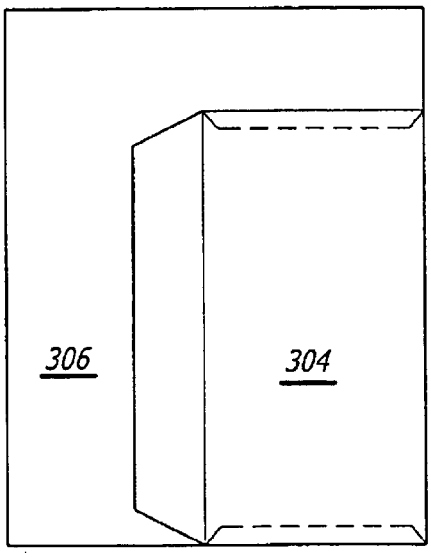
FIG. 9 shows the front and back sides of the assembly of FIG. 8 after the assembly has been folded and glued to form an envelope releasably attached to the L-shaped extended portion.
Figure 9B:
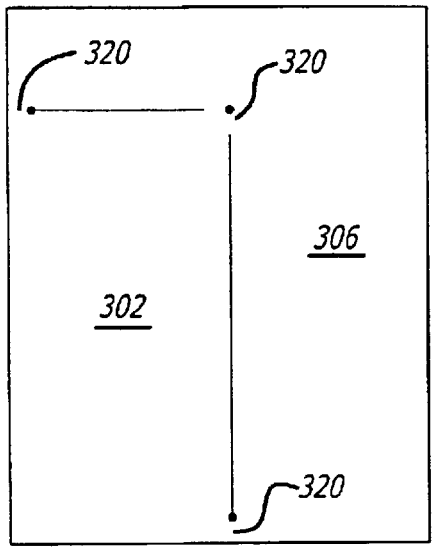

FIG. 9 depicts the unitary envelope assembly of FIG. 8 folded to form a unitary folded envelope assembly having dimensions of 8-½ in.×11 in., ready to be fed into a printer and printed thereon. FIG. 9A shows the front of the assembly including the envelope front 304, and FIG. 9B shows the back of the assembly including envelope back 302. The envelope is releasably connected to the carrier or extended portion 306 by a plurality of ties 320. Ties 320 maintain the integrity of the assembly as it is being printed. In this configuration the assembly may be loaded in bulk into a standard size printer tray, have addresses and stamps printed thereon by the printer in a simple printing step, and then separated from extended portion 306 by tearing ties 320 in a single motion. The envelope may be stuffed before being separated from extended portion 306. If the envelope is stuffed before being separated from extended portion 306, the extended portion helps to guide the material into the envelope. If the envelope is stuffed after being separated from the extended portion 306, the release strip as in the fourth above-described variation protects the PSA during stuffing.

In all of the embodiments the envelope assembly is preferably fed into the printer in a direction that is compatible with the printing feed direction of the printer.

It will be appreciated that the term "present invention" as used herein should not be construed to mean that only a single invention having a single essential element or group of elements is presented. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, different size envelopes may be used, different types of envelopes such as windowed or unwindowed envelopes may be used, different weights of paper may be used, and the assembly may be constructed to various sizes including but not limited to standard 8-½ in.×11 in., 8-½ in.×14 in., A-4, or other sizes. Various adhesive materials and techniques may be suitably substituted for the particular adhesives discussed. It will also be understood that even if the assembly has dimensions that vary slightly from standard paper size, the assembly may nevertheless function acceptably in a printer or copier. In the specification and claims therefore, the term "standard size" will be understood to mean approximately standard size, and "8-½ in.×11 in." and "A-4" will be understood to mean approximately those sizes. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A printable envelope assembly comprising:

an envelope having a front side, a back side, an opening, and a sealing flap;

a generally L-shaped paper carrier defining an acute angle between portions thereof; a release material disposed between said paper carrier and the closure flap to prevent the closure flap from permanently adhering to the carrier; and said L-shaped carrier being releasably adhered to the back side of said envelope in the regions of a corner of said envelope and the sealing flap to form an overall paper assembly having a length and width commensurate with a standard paper size;

whereby a plurality of said envelope assemblies each having a footprint of a standard paper size may be loaded together into a standard size paper tray of a personal computer printer and printed thereon in succession without human intervention and without skewing or printer errors, the envelopes thereafter stuffed with material to be mailed, and the carriers thereafter easily peeled away to leave just the stuffed envelopes without the carriers.

2. The assembly of claim 1 wherein a leg of said L-shaped carrier is sufficiently wide at an outer end to allow said leg to be reliably but releasably adhered to said envelope, said leg tapering to a narrower inner end which overlaps the envelope opening only slightly, thereby allowing nearly complete access to said opening to allow the envelope to be stuffed while held to said carrier.

3. The assembly of claim 2 wherein said carrier and said envelope are releasably adhered together using at least one adhering means selected from the group consisting of a pressure sensitive in combination with a release material, and a dry laminate.

4. A printable envelope assembly suitable for loading into a standard size paper tray of a printer, comprising:

an envelope; and a generally L-shaped paper carrier member releasably adhered to said envelope;

wherein said L-shaped member is disposed on a back side of said envelope, and said L-shaped member overlaps said envelope by less than approximately 0.25 inches at an upper left corner of the back side of said envelope but by more than approximately 0.25 inches at a lower left corner of the back side of said envelope.

5. A printable envelope assembly suitable for loading into a standard size paper tray of a printer, comprising:

an envelope; and a generally L-shaped paper carrier member releasably adhered to said envelope;

wherein said envelope and said L-shaped member together define a generally flat paper assembly having a length and a width of a standard paper size.

6. The assembly of claim 5 wherein said standard paper size is 8-½ in.×11 in.

7. The assembly of claim 5 wherein said standard paper size is A-4.

8. The assembly of claim 5 wherein said assembly defines a paper assembly suitable for loading into a lower cassette tray of a personal computer printer.

9. A printable envelope assembly comprising:

an envelope having a back side and a lower left corner thereon, said envelope further having a closure flap; and a generally L-shaped paper carrier member releasably adhered to said envelope, said generally L-shaped member has a main portion and a leg portion;

and wherein:

said L-shaped member leg portion partially overlaps said envelope lower left corner and is releasably adhered thereto; and said L-shaped member main portion partially overlaps said closure flap and is releasably adhered thereto.

10. The assembly of claim 9 wherein said main portion and said leg portion of said L-shaped member define an angle of less than or equal to 90 degrees therebetween, said leg portion only slightly overlapping said envelope near an opening of said envelope such that a user can access nearly the entire envelope opening for stuffing purposes while the L-shaped member is still adhered to the envelope.

11. The assembly of claim 5 further comprising:

a release strip disposed between said L-shaped member and a closure adhesive on said closure flap.

12. The assembly of claim 5 wherein said L-shaped member is adhered to a back side of said envelope.

13. The assembly of claim 5 wherein said L-shaped member is adhered to a front side of said envelope.

14. A printable envelope assembly comprising:

an envelope; and a generally L-shaped paper carrier member releasably adhered to said envelope;

wherein said L-shaped member and said envelope are differently colored.

15. A printable envelope assembly comprising:

an envelope; and a carrier releasably adhered to said envelope, said envelope and said carrier together generally conforming to a standard paper size, said assembly being suitable for loading into a tray of a printer and feeding into the printer, said envelope being releasable from said carrier after being fed through the printer and printed thereon by the printer;

wherein said envelope has diagonally cut side and back assembly flaps, and wherein said carrier includes a leg portion and a vertical portion defining an angle of less than or equal to 90 degrees therebetween.

16. The printable envelope assembly of claim 5 wherein said envelope has a gummed closure flap and said carrier is releasably adhered to a front side of said envelope.

17. The printable envelope assembly of claim 5 wherein said envelope has a closure flap carrying a pressure sensitive adhesive thereon, said carrier is disposed on a back side of said envelope, and said carrier includes a release material where said carrier touches said pressure sensitive adhesive.

18. The printable envelope assembly of claim 5 wherein said envelope is treated with a removable adhesive before being assembled with said carrier, said removable adhesive transferring to said carrier when said carrier is thereafter separated from said envelope.

19. The printable envelope assembly of claim 5 wherein said envelope is at least partially adhered to said carrier using a dry laminate process.

* * * * *